US005536371A

United States Patent [19]

Verhoff

[11] Patent Number: 5,536,371

[45] Date of Patent: Jul. 16, 1996

[54] PAPERMAKING SLUDGE RECOVERY PROCESS AND APPARATUS

[75] Inventor: Charles R. Verhoff, Deshler, Ohio

[73] Assignee: The Onix Corporation, Deshler, Ohio

[21] Appl. No.: 196,279

[22] Filed: Feb. 10, 1994

[51] Int. Cl.[6] ..... D21F 1/66

[52] U.S. Cl. ..... 162/189; 162/DIG. 9; 162/47; 34/592

[58] Field of Search ..... 162/29, 30.1, 31, 162/189, 47, 55, 100, 181.8, 190, DIG. 9, 189; 110/216, 217, 224, 346; 210/920; 119/172, 173; 34/576, 592, 60, 168; 252/62; 514/75

[56] References Cited

U.S. PATENT DOCUMENTS

| | | | |
|---|---|---|---|
| 2,026,969 | 5/1932 | Flynn | 110/15 |
| 3,643,344 | 2/1972 | Strube | 34/122 |
| 3,765,921 | 10/1973 | Puskar | 106/288 B |
| 3,876,497 | 4/1975 | Hoffmann | 162/189 |
| 3,941,872 | 3/1976 | Puskar | 423/331 |
| 4,077,847 | 3/1978 | Choi et al. | 201/21 |
| 4,133,273 | 1/1979 | Glennon | 110/222 |
| 4,179,263 | 12/1979 | Jung et al. | 432/1 |
| 4,356,060 | 10/1982 | Neckermann et al. | 162/181.6 |
| 4,363,739 | 12/1982 | Okamura et al. | 252/62 |
| 4,640,681 | 2/1987 | Steinbiss et al. | 432/14 |
| 4,692,167 | 9/1987 | Lenasseur | 44/2 |
| 4,756,719 | 7/1988 | Santo | 44/541 |
| 5,011,534 | 4/1991 | Berube et al. | 106/416 |
| 5,018,459 | 5/1991 | Judd | 110/346 |
| 5,019,564 | 5/1991 | Lowe et al. | 514/75 |
| 5,137,599 | 8/1992 | Maxham | 162/5 |
| 5,199,987 | 4/1993 | Ernstbrunner | 106/761 |
| 5,240,728 | 8/1993 | Grenet et al. | 426/461 |
| 5,251,383 | 10/1993 | Williams | 34/12 |
| 5,309,849 | 5/1994 | Krebs | 110/224 |

FOREIGN PATENT DOCUMENTS 272950 6/1988 European Pat. Off. .

*Primary Examiner*—Donald E. Czaja
*Assistant Examiner*—Calvin Padgett
*Attorney, Agent, or Firm*—Thompson Hine & Flory

[57] ABSTRACT

A process and an apparatus for recovering clay and fiber from papermaking sludge. The sludge is dried, milled, and separated into distinct clay and fiber components. The fiber component of the sludge is then used as an alternative fuel source. The clay component can be used as recycle into the papermaking process, a masonry additive, or for any other suitable purpose.

26 Claims, 1 Drawing Sheet

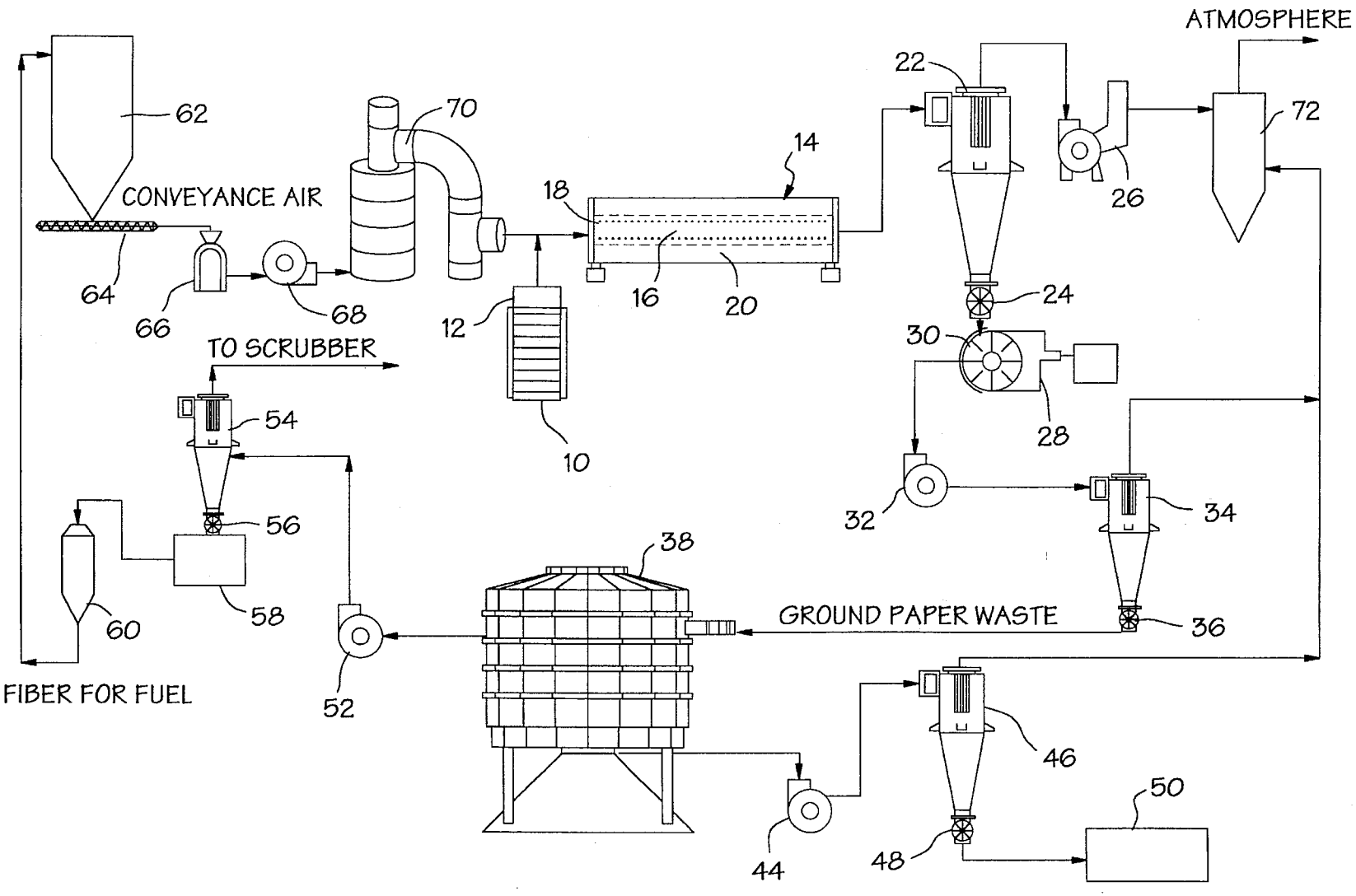
ATMOSPHERE
72
26
22
24
28
30
32
34
36
50
46
48
44
GROUND PAPER WASTE
14
20
16
18
10
12
38
70
68
CONVEYANCE AIR
66
64
62
TO SCRUBBER
54
56
58
52
60
FIBER FOR FUEL

PAPERMAKING SLUDGE RECOVERY PROCESS AND APPARATUS

This invention relates to a process and apparatus for the recovery of the clay content of papermaking sludge and the recovery and use of the fiber content of papermaking sludge to provide an alternative fuel source.

BACKGROUND OF THE INVENTION

Paper manufacture involves the blending of pulp (mainly wood fiber) with clay filler, retention aids such as calcium carbonate, latex dyes, and defoamers and running the slurry into a paper machine where it is formed into a sheet. In this process, some of the fiber and filler escape. The portions which escape and those portions which are unused in the papermaking process are collected by the paper mill in a paper sludge. The sludge is fed to a gravity thickener (if required to concentrate the sludge) and then to a dewatering device (usually a belt filter press, vacuum filter or screw press) which reduces the water content to approximately 50% to 80%.

Previously in the papermaking industry, waste paper sludge was burned as a part of the firing for the digesting process. The burning of the sludge is not particularly efficient because of its water content and because of its high ash content. Furthermore, the fiber content of the sludge further has a low heat value. Finally, steam generated by power boilers burning the sludge has a low intrinsic heat value.

One patent does disclose a method for recycling paper sludge. U.S. Pat. No. 5,137,599 to Maxham teaches a process for converting pulp and paper mill waste solids into a papermaking fibrous pulp of substantially the same quality as used by the pulp and paper mill to make its paper products. In this process, papermaking sludge is defibered to release individual fibers, screened to separate long fibers from short fibers, centrifugally cleaned to separate debris from the long fibers, bleached to increase the brightness of the fibers, dewatered to remove excess water from the pulp, clarified to separate short fibers and clay from the defibering effluent, and biologically treated to remove dissolved organic materials from the excess water generated which is either discharged from the process or recycled as process water.

U.S. Pat. No. 5,137,599 to Maxham fails to disclose a method in which the recovered cellulosic fibers are recycled back into the recovery process to generate heat for a dryer which dries the sludge.

SUMMARY OF THE INVENTION

The method of the present invention provides a means of separating paper mill sludge into its clay and fiber components. The fiber content of the sludge is recovered and used as an alternative fuel source. The clay content of the sludge is recovered and then can be recycled into the papermaking process, used as a masonry additive, or used for any other purpose for which it may be suitable. Thus, the prior art problems involved in the recovery and combustion of waste paper sludge are resolved.

This invention provides a method for recovering the cellulosic fibers and clay from waste papermaking sludge and converting its fibrous content into an alternative fuel source. One embodiment of the invention includes the steps of: providing a papermaking sludge containing clay and fiber; drying the sludge; reducing the particle size of the dried sludge to provide a milled sludge having a particle size at which the clay and fiber components can be separated from one another; and separating the dried sludge into separate clay and fiber components. More particularly, it relates to a closed loop system in which clay is recovered from the sludge and the fiber content is used to fuel the dryers utilized in the process. The sludge solids are drawn through the process by a system of air conveyance fans and associated cyclone separators. The sludge is first fed into a wet product feeder at approximately 50% consistency. It is then dried in a triple-pass dryer. The dried sludge is removed from the air stream in a cyclone separator and, thereafter, fed into a hammer mill. The hammer mill grinds the dried material to a particle size which enables the clay to be removed from the fiber. Upon exiting the hammer mill, the product is fed into a second cyclone separator which again acts to remove the dried and milled sludge from the air stream and the product is sorted by a mechanical sorter in which the cellulose fibers of the paper sludge are separated from the clay in the dried sludge. The clay can then be recycled back into the papermaking process or used for any purpose for which it is suitable. The cellulose fibers are fed into a pellet mill in which they are pelletized. The fiber pellets are then either used alone or mixed with sawdust and combusted in a furnace. This process preferably is a closed loop process in which the Btu value of the combusted fiber in the waste is used to heat the air which dries the sludge.

BRIEF DESCRIPTION OF THE DRAWINGS

While the specification concludes with claims particularly pointing out and distinctly claiming the present invention, it is believed that the invention is better understood from the following description taken into conjunction with the associated drawing, in which like elements are designated by the same reference numeral and:

FIG. 1 is a flow diagram illustrating the process of this invention.

DETAILED DESCRIPTION OF THE INVENTION

The papermaking sludge used in connection with this invention can be obtained from any commercially available source. It may be recovered from the papermaking process by the paper mill itself or obtained from a paper mill for use with this process. The papermaking sludge which can be treated in accordance with this invention may have a water content of up to 80%, with approximately 50% being preferred. The solid content of the papermaking sludge will vary with the source of the paper and the particular paper being manufactured. The solid component of the sludge generally comprises clay, cellulosic fibers, calcium carbonate and small quantities of casein, proteins, starch, latex dyes, defoamers and titanium dioxide. One example of a sludge contains about 40% clay, 30% cellulosic fibers, 19% calcium carbonate, 5% casein, protein and starch, 5% latex dye and defoamers, and 1% titanium dioxide.

The waste paper sludge is fed into a wet product feeder 10 by means of a mechanical conveyor (not shown). The wet product feeder 10 contains a leveling drum 12 which levels off the material to provide an even flow of material into the dryer 14. The wet product feeder 10 is commercially available and the unit used with this process is available from Veroff Machine Welding under the product designation FE-12.

After being pressed into a mat, the paper is fed to a dryer 14 by means of an auger conveyor (not shown). The wet product moves through the dryer 14 by means of an air current created by a first conveyance air fan 26, which will be discussed later. The dryer 14 is preferably a 12 foot triple-pass dryer. One triple-pass dryer useful in the invention includes three coaxial drying chambers through which the wet sludge sequentially passes as it is dried. The first chamber 16 is located at the center of the dryer. The second chamber 18 is coaxial with the first chamber 16 and the third chamber 20 is coaxial with the second chamber 18. The product is drawn into the dryer 14 by the air flow produced by a conveyance air fan 26 and travels the length of the dryer 14 in the main drying drum, the first chamber 16. When it reaches the end of the first chamber 16, it is drawn through the second chamber 18, back toward the first end of the dryer 14 and then through the third chamber 20 which surrounds the second chamber 18 and from which the dried particles exit the dryer 14. The heat for the dryer 14 is provided by the burner 70, which will be discussed below. The dryer 14 is available from Productization under the commercial product designation 130-600-3pHv.

The air flow from the conveyance air fan 26 draws the dried sludge into the cyclone separator 22, which is commercially available from Fisher-Klosterman under the product designation XQ-170-60. The cyclone separator 22 is designed to remove the dried sludge .from the air stream. This generates approximately 40 pounds per hour of particulate waste, e.g., particles less than 8 microns, which is siphoned off by the conveyance air fan 26 and removed in an air scrubber 72. In the preferred embodiment, the separator 22 has a 3–12 foot diameter, with a 6 foot diameter being preferred. In the preferred embodiment, the cyclone separator 22 can handle up to 12 wet tons per hour and demonstrates an efficiency of greater than approximately 99%. At its bottom, the separator 22 has an air lock 24 which allows the solids to exit the separator 22 and which prevents an infeed of air into the separator 22. The air lock 24 also prevents the solid material from being drawn up into the air stream of the conveyance air fan 26. The air lock 24 used in the preferred embodiment has 24×24 inch dimensions and is available from KICE Industries under the commercial product designation VWO series.

The conveyance air fan 26 used first in this process provides air flow for the triple-pass dryer 14 and the cyclone 22. The fan 26 pulls air through the system at a rate of approximately 60,000 cubic feet per minute in the preferred embodiment This provides an air flow strong enough to pull the wet sludge solids through the dryer 14 and into the cyclone 22. The conveyance air fan 26 has a 200–350 hp motor, with 250 hp motor being preferred, and is available from Cincinnati Fan ZERN. Air flows through the fan 26 and into an air scrubber 72 which removes particulate from the air before it is released into the environment.

Once the solid matter exits the cyclone 22, through the airlock 24, it is deposited into a hammer mill 28 where it is ground to a size which allows it to exit the hammer mill 28 through the hammer mill screen 30. The size of this screen 30 is important. It is found that the hammer mill screen 30 should have a mesh size of about 1/16 to 7/64 inch, with a 5/64 inch screen being preferred. A larger screen may permit clay particles to become mixed in with the cellulose fibers after separation. A smaller screen may cause the cellulose fibers to be ground so finely that the dried sludge cannot be separated into its component parts, i.e., the cellulose fibers fall through the screen 30 of the mechanical screen separator 38 with the clay particles. The sorting step of this process is described below. The hammer mill 28 can have a 200–350 hp motor, with a 250 hp being preferred. A suitable hammer mill is commercially available from Champion under the commercial product designation HM4400-42.

Because of the small size of the screen 30, the solid matter must be drawn through the hammer mill 28 by another conveyance air fan 32. This fan 32 draws air through the hammer mill 28 and a second cyclone 34 at a rate of about 15,000 cubic feet per minute. This second fan 32 is also exhausted to the air scrubber 72.

Upon passing through the hammer mill screen 30, the solid matter is drawn into a second cyclone separator 34. In the preferred embodiment, the separator 34 is smaller than the first. This smaller size, however, is not essential. The cyclone separator 34 can have a 3–12 foot diameter, with a 4 foot diameter being preferred. The cyclone separator 34 acts to remove the solids from the air stream. Again, any particulate matter less than about 8 microns in size would be siphoned off with the air stream and disposed of in the air scrubber 72. Like the first cyclone separator 22, this second separator 34 also contains an air lock 36 which prevents the solid matter from being pulled into the second conveyance air fan 32. The cyclone separator 34 is also available commercially from Fisher-Klosterman under the product designation XQ-340-51.

The recovered solid material exits the cyclone 34 through the air lock 36 and is deposited into a mechanical screen sorter 38. The screen 40 on the sorter 38 can have a mesh of approximately 150 to 200, with 170 being preferred. Suitable mechanical screen sorters are available from Minox under the product designation MTS 2000. The sorter 38 sorts the fibrous material from the clay by a combination of tossing and oscillation action. The clay passes through the screen 40 to the base 42 and the fibrous material remains on the screen 40 as the solids are sorted. The resulting material left on the screen 40 consists mostly of cellulose fibers.

Once the clay particles exit the mechanical screen separator 38 through the base 42, they are pulled by a third conveyance air fan 44 into a third cyclone separator 46. The conveyance air fan 44 used in this stage can range from 10–30 hp with a 20 hp fan available from Cincinnati Fan being preferred. At this stage of the process, the cyclone separator 46 acts to remove the clay from the air. The air removed by the cyclone separator 46 is exhausted to the air scrubber 72 for emission into the environment. The cyclone separator 46 can have a diameter of 3–12 feet. In the preferred embodiment, it has a 32 inch diameter and is available from Fisher-Klosterman under the commercial product designation XQ-120-25. The clay passes through an air lock 48 and into the clay storage bin 50. The air lock 48 has an inlet measurement of 15 in×15 in. in the preferred embodiment. The air lock 48 is available from KICE Industries under the commercial product designation VWO series.

As the clay particles are being moved to the storage bin 50, the cellulose fibers are drawn off the screen 40 of the mechanical screen sorter 38 by the air stream from a fourth conveyance air fan 52. This fan 52 has the same specifications as the third fan 44. The fan 52 feeds the cellulose fibers into a fourth cyclone separator 54. This cyclone separator 54 acts to remove the remaining fibers from the air. This fourth cyclone separator 54 has the same parameters as the third cyclone separator 46, described above. Once the fibers are separated, they are fed through an air lock 56 in the bottom of the cyclone separator 54 into the fiber storage bin 58. The fourth air lock 58 also has the same parameters as the third air lock 48, described above.

Depending upon the quality of the fibers which are recovered up to this point in the process, the fibers are either used as an alternative fuel source or recycled into the papermaking process. If the fibers are of sufficient quality, then they can be recycled back into a papermaking process. If the fibers are not capable of being recycled into the papermaking process, then they are used as an alternative fuel source which can be used to fire the burner 70.

If the fibers are used as a fuel source, they are fed from the fiber storage bin 58 into a pellet mill 60. The pellet mill 60 acts to compress the loose cellulosic fibers into pellets. The fibers are compressed into pellets because pellets are easier to store and easier to transport than loose fibers. The pellet mill 60 employed in the preferred embodiment of this invention is available from California Pellet Mills under the commercial product designation 7932-9. The pellets are then fed into the fuel storage bin 62.

In the fuel storage bin 62, the pellets may be mixed with sawdust. The sawdust can be obtained from commercial sources or recovered from a different step in the papermaking process. The pellets may be combined with the sawdust in any quantity which will provide a mixture yielding enough heat to supply the dryer 14. To ensure efficient operation of the dryer 14, the mixture must have a Btu rating of at least approximately 7,500 Btu/lb. Thus, if the Btu value of the recovered fiber sufficiently supplies a Btu value greater than or equal to 7,500 Btu/lb., then little or no sawdust would be required. Sawdust may also be added in sufficient quantity to ensure that the mixture would comply with environmental emission standards.

If the pellets are used as an alternative fuel source to fire the burner 70 to provide heat for the dryer 14, they must be in a ground pellet form. The pellets and the sawdust, if necessary, are fed from the fuel bin 62 into a second hammer mill 66 by the fuel feed auger 64. This hammer mill 66 has a 50 to 100 hp motor, with a 50 hp motor being preferred. In the preferred embodiment, the hammer mill 66 is manufactured by Champion and has the commercial product designation HM4400-12. The hammer mill 66 acts to grind the pellets to a 0.25 in size. As the pellets are ground, they become intimately mixed with the sawdust, thus forming a fuel mixture.

The ground pellet-sawdust mixture is then fed into the burner 70 to be used as a fuel source. The fiber-sawdust mixture is fed from the second hammer mill 66 and into the burner 70 by the fifth conveyance air fan 68. The mixture is fed into the burner 70 at a 30° angle which creates a vortex effect in the burner 70. This vortex effect, caused by the fan 68 which feeds the mixture into the burner 70 and five other fans (not shown), provides for almost complete combustion of the mixture. The fiber-sawdust mixture, when combusted in this manner, produces an ash content of approximately 0.5 to 2.0%. The burner 70 has a heat value rating of 40–100 million Btu. The burner 70 used in the preferred practice of this process is a 60 million Btu burner available from Onix Corporation under the product designation WB 60.

As stated above, the preferred embodiment of this invention is a closed loop system. The burner 70 provides the heat used by the triple-pass dryer 14 to dry the waste paper sludge so that the fiber can be separated out and used as fuel for the burner 70. Heated air is drawn off the top of the burner 70 by the air stream created by the first conveyance air fan 26. The heated air from the burner 70 flows directly from the burner 70 into the dryer 14. Thus, the air fan 26 pulls the heated air through the dryer 14 along with the wet sludge. The burner 70 provides enough heat to remove water from the sludge at the rate of approximately 16,750 pounds per hour at a temperature of about 117° F.

To comply with environmental emission regulations, air exhausted from conveyance air fan 26 and cyclone separators, 34, 46 and 54, respectively, is fed into an air scrubber 72. For example, air exiting the conveyance air fan 20 contains approximately 40 pounds of particulate matter per hour and the scrubber reduces the plant emission to approximately 5 pounds per hour. The air scrubber 42 is available from The Onix Corporation under the commercial product designation SE-60M.

While particular embodiments of the present invention have been illustrated and described, one skilled in the art will appreciate that change and modifications can be made without departing from the spirit and scope of the invention.

What is claimed is:

1. A process for recovering clay and fiber from papermaking sludge comprising the steps of:

providing a papermaking sludge containing a clay component and a fiber component;

drying the sludge;

reducing the dried sludge to provide a milled sludge having a particle size at which the clay and fiber components can be separated from one another; and separating the milled sludge into distinct clay and fiber components.

2. The process of claim 1 further comprising the step of burning the fiber component to generate heat for drying the sludge.

3. The process of claim 2 wherein the fiber component is combined with sawdust before burning.

4. The process according to claim 2 wherein, prior to burning, the fiber component is compressed into pellets.

5. The process according to claim 1 wherein the process additionally includes the steps of withdrawing the dried sludge from a dryer, conveying the dried sludge by a conveyance air stream and removing the dried sludge from the air stream.

6. The process of claim 1 wherein the step of drying the sludge is carried out in a dryer having coaxial drying chambers.

7. The process of claim 5 further comprising the step of removing the dried sludge from the air stream before reducing the particle size.

8. The process of claim 7 in which the step of removing the dried sludge from the air stream is performed in a cyclone separator.

9. The process of claim 1 wherein the step of reducing the particle size of the dried sludge is carried out in a hammer mill.

10. The process of claim 9 wherein the hammer mill contains a screen having approximately a 1/16 to 7/64 inch mesh.

11. The process of claim 10 wherein the screen has approximately a 5/64 inch mesh.

12. The process of claim 10 further comprising the step of conveying the milled sludge in a conveyance air stream and removing the milled sludge from the air stream.

13. The process of claim 12 wherein the step of removing the milled sludge from the air stream is performed in a cyclone separator.

14. The process of claim 1 wherein the step of separating the milled sludge is carried out in a mechanical screen sorter.

15. The process of claim 14 wherein the mechanical screen sorter has a screen having a 170 mesh.

16. The process of claim 1 further comprising the step of conveying the clay component in a conveyance air stream and removing the clay component from the air stream.

17. The process of claim 16 wherein the step of removing the clay component from the air stream is performed in a cyclone separator.

18. The process of claim 1 further including the steps of conveying the fiber component in a conveyance air stream and removing the fiber component from the air stream.

19. The process of claim 18 wherein the step of removing the fiber component from the air stream is performed in a cyclone separator.

20. A process for recovering clay and fiber from papermaking sludge comprising the steps of:

providing a papermaking sludge containing a clay component and a fiber component;

drying the sludge;

withdrawing the dried sludge from a dryer;

conveying the dried sludge by means of a conveyance air stream;

removing the dried sludge from the air stream;

reducing the dried sludge to provide a milled sludge having a particle size at which the clay and fiber can be separated from one another;

separating the milled sludge into distinct clay and fiber components;

conveying the clay component in a conveyance air stream;

removing the clay component from the air stream;

conveying the fiber component in a conveyance air stream;

removing the fiber component from the air stream; and burning the fiber component to generate heat for the step of drying the sludge.

21. An apparatus for recovering clay and fiber from papermaking sludge comprising:

a dryer positioned and arranged for drying the sludge;

a mill positioned and arranged for reducing the dried sludge to a particle size at which the clay and fiber can be separated;

a separator positioned and arranged for separating the dried sludge into separate clay and fiber components;

vortex furnace positioned and arranged for providing heat for the dryer by burning the fiber component; and an air conveyance system positioned and arranged for providing a conveyance air stream wherein particles are conveyed throughout the apparatus by the air conveyance system.

22. The apparatus of claim 21 further comprising:

one or more cyclone separators positioned and arranged for removing particulate matter from the conveyance air stream.

23. The apparatus of claim 22 further comprising:

a compressor positioned and arranged for compressing the fiber component into pellets.

24. The apparatus of claim 21 wherein the dryer is a triple-pass dryer having three coaxial drying chambers.

25. The apparatus of claim 21 wherein the mill for reducing the particle size is a hammer mill.

26. The apparatus of claim 21 wherein the separator for separating the dried sludge is a mechanical screen sorter.

* * * * *

UNITED STATES PATENT AND TRADEMARK OFFICE

CERTIFICATE OF CORRECTION

PATENT NO. : 5,536,371

DATED : July 16, 1996

INVENTOR(S) : Charles R. Verhoff

It is certified that error appears in the above-indentified patent and that said Letters Patent is hereby corrected as shown below:

Column 6, claim 12, line 56, the term "step" should be --steps--.

Column 6, claim 16, line 65, the term "step" should be --steps--.

Signed and Sealed this

First Day of October, 1996

Bruce Lehman

*Attest:*

BRUCE LEHMAN

*Attesting Officer*

*Commissioner of Patents and Trademarks*